United States Patent [19]

Megowen

[11] Patent Number: 4,611,723

[45] Date of Patent: Sep. 16, 1986

[54] CONTAINER CLOSURE WITH EXPANDABLE ANTI-MISSILING SECTION

[76] Inventor: William Megowen, 4 Baker's Brook, South Dartmouth, Mass. 02748

[21] Appl. No.: 787,037

[22] Filed: Oct. 15, 1985

[51] Int. Cl.[4] ..... B65D 51/16

[52] U.S. Cl. ..... 215/252; 215/307

[58] Field of Search ..... 215/252, 307, 260

[56] References Cited

U.S. PATENT DOCUMENTS

| | | | |
|---|---|---|---|
| 3,861,551 | 1/1975 | Hannon | 215/252 |
| 3,966,071 | 6/1976 | Northup | 215/307 X |
| 4,007,848 | 2/1976 | Snyder | 215/252 X |
| 4,007,851 | 2/1977 | Walker | 215/307 |

*Primary Examiner*—Donald F. Norton

*Attorney, Agent, or Firm*—Joseph S. Iandiorio; William E. Noonan; Douglas E. Denninger

[57] ABSTRACT

An improved container closure including a shell with top and side walls. The shell is disposable over an opening in a container. In the shell are a threaded portion in the side wall for engaging threads on the container and an axially expandable section. A safety section in the side wall below the expandable section provisionally secures the shell to a fixed element on the container at least until the expandable section expands.

17 Claims, 8 Drawing Figures

CONTAINER CLOSURE WITH EXPANDABLE ANTI-MISSILING SECTION

FIELD OF INVENTION

This invention relates to a container closure which permits venting of pressurized gas while the closure remains secured to the container to dramatically reduce the risk of missiling, and more particularly to such a container closure which is longitudinally expandable.

BACKGROUND OF INVENTION

Many carbonated beverages are packaged in bottles with removable screw caps threaded over the opening of the bottle. Pressurized gas in the headspace above the liquid in the bottle can develop a pressure of over 100 p.s.i. If the bottle closure is disengaged from the threads of the bottle before the underlying gas is sufficiently vented, the bottle closure can escape at rates of over 100 miles per hour: this problem is termed closure-missiling.

The problems of closure-missiling are most apparent with roll-on closures where a closure shell is forcibly threaded onto the neck of the bottle using the threads of the bottle to form matching threads in the closure shell. Frequently, a fixed annular element such as a depression or a ridge is provided on the bottle below the threads; the lower portion of the closure shell is rolled about the fixed element to secure the shell to the bottle. The portion of the shell engaging the fixed element is termed the tuck. The tuck is part of a pilfer-proof device which is partially perforated with vertical and/or horizontal slots spaced about the tuck. The tuck can be part of a solid ring attached by nibs to the upper portion of the shell so that the ring detaches at the nibs when the shell is initially rotated and remains behind after removal of the shell. Alternatively, the ring is partially perforated and splits upon rotation of the shell as it is lifted past the fixed element of the bottle and is removed with the shell. One such device is the Alcoa Eight-Score Pilfer-Proof Device.

Upon initial rotation of a conventional bottle closure, the pilfer-proof device is breached. As the closure continues to rotate, gas escapes between the closure and the threads of the bottle. Several patents have sought to enhance the venting after the breach of the pilfer-proof device. For example, Walker, U.S. Pat. No. 4,007,851, provides safety vents in the side walls of the closure proximate the top. Snyder, U.S. Pat. No. 4,007,848, discloses an anti-missiling bottle structure with channels passing through the threads of the bottle. The problem with these venting mechanisms is that closures which are misapplied to the bottle threads, that is, have not developed sufficient thread depth to engage the closure to the bottle threads, are retained primarily by the pilfer-proof device, which, once breached, completely disengages the closure from the bottle almost instantaneously. However, conventional devices such as those of Walker or Snyder contemplate a rotation of at least ten or twenty degrees, and preferably ninety degrees, to allow sufficient time for venting to occur. Bottle caps with misformed threads can missile before this amount of rotation is achieved.

Further, when similar forces strip or deform the threads and rupture the pilfer-proof device, the threads in the cap are freed from the bottle at the same time that the pilfer-proof device no longer secures the cap. No time is available for venting and missiling of the cap results.

SUMMARY OF INVENTION

It is therefore an object of this invention to provide an improved container closure which prevents missiling of the closure even after rotation of the closure begins.

It is a further object of this invention to provide such a closure which vents pressurized gas before a conventional pilfer-proof device is breached.

It is a further object of this invention to provide such a closure which uses the intact pilfer-proof device as a safety ring to restrain the closure during venting.

It is a further object of this invention to provide such a closure which operates when the closure is conventionally rotated.

A still further object of this invention is to provide an improved bottle cap for carbonated beverages which prevents missiling of the cap.

This invention features an improved container closure. There are a shell with top and side walls and disposable over an opening in the container, and a threaded portion in the side wall for engaging threads on the container. There are also an axially expandable section in the shell and a safety section in the side wall below the expandable section for provisionally securing the shell to a fixed element on the container at least until the expandable section expands.

In one embodiment, the expandable section includes a plurality of slots disposed in the side wall which expand when the shell is rotated in a first direction to eventually disengage the shell from the container. The slots may be arranged in at least two bands about the shell such that the slots in one band are staggered relative to the slots in the other band. Alternatively, the slots are oriented transversely to the orientation of threads in the threaded portion and the threads are inclined upward in a second direction while the slots are oriented upward in a third direction which is at least 90° from the second direction. The expandable section may be disposed below the threaded portion.

In another embodiment, the expandable section requires less force to expand than is required to release the safety section from the fixed element. The safety section may include a frangible portion and the expandable section enables venting of pressure within the shell sufficiently to prevent closure-missling during initial rotation of the shell before the safety section releases the fixed element. The expandable section may include metal.

This invention also features an improved container closure including a shell with top and side walls and disposable over an opening in a container, an axially expandable section in the shell, and a safety section in the side wall below the expandable section.

This invention may also be expressed as an improved container closure in combination with a pressurized-fluid container having external threads proximate its opening and having a fixed element below the threads. The container closure includes a shell with top and side walls and disposable over the opening, a threaded portion in the side walls for engaging the threads on the container, and an axially expandable section in the shell. There is also a safety section in the side wall below the expandable section for provisionally securing the shell to the fixed element on the container at least until the expandable section expands. The fixed element may be annular.

DISCLOSURE OF PREFERRED EMBODIMENT

Other objects, features and advantages will occur from the following description of a preferred embodiment and the accompanying drawings, in which.

This invention may be accomplished by a container closure such as a bottle cap which includes a novel axially expandable section in the shell of the cap. The expandable section can include metal with slots or perforations which allow the metalwork to stretch or deform axially when the cap is unscrewed from a bottle. The shell also includes a safety section which axially anchors the shell to the bottle until the expandable section has expanded.

When the bottle contains pressurized fluid, the safety section restrains the cap until the expandable section has expanded to permit sufficient venting of pressurized gas. Missiling of the cap is thereby prevented.

Figure 1:
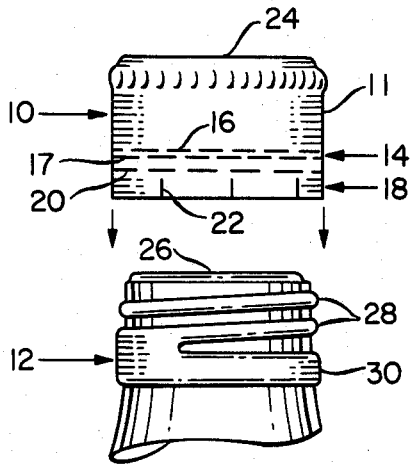
FIG. 1 is an elevational plan view of the neck of a bottle and a bottle cap, before the cap is rolled onto the bottle, including a safety section and an expandable section according to the invention.

Closure 10 including metallic shell 11 is shown in FIG. 1 prior to placement over the opening of bottle 12. Shell 11 includes expandable section 14 which in this construction includes slots arranged in two staggered bands 16, 17. Shell 11 also includes safety section 18, such as an Alcoa eight-score pilfer-proof device, which has horizontal slits 20 and vertical slits 22 that enable closure 10 to eventually disengage from bottle 12.

Closure 10 also includes a liner within top wall 24 which seats against rim 26 of bottle 12 after shell 11 is disposed over bottle 12. Bottle 12 includes threads 28 and annular fixed element 30 about which shell 11 is rolled.

Figure 2A:
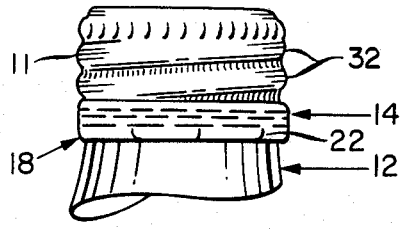
FIG. 2A is an elevational plan view of the cap of FIG. 1 after it is rolled onto the bottle.

After rolling, FIG. 2A, shell 11 develops threaded portion 32 in its side wall. Safety section 18 is rolled over and tucked under the bottom of fixed element 30 which is no longer visible beneath shell 11.

Figure 2B:
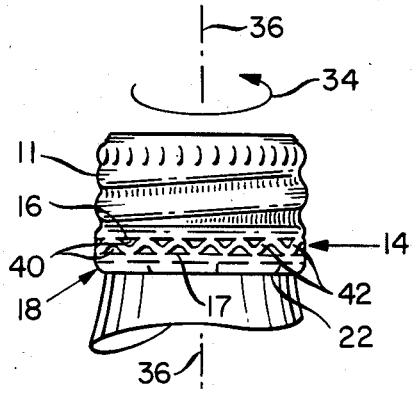
FIG. 2B is an elevational plan view of the cap of FIG. 2A after the expandable section is expanded during initial opening rotation.

Upon initial opening rotation of shell 11 in the direction indicated by arrow 34, FIG. 2B, about axis 36, expandable section 14 expands axially. Slots 16, 17 enlarge into openings 40; metal between slots 16, 17 becomes ties 42 extending from the upper boundary of slots 16 to the lower boundary of slots 17. Safety section 18 remains secured to the fixed element of bottle 12.

By allowing the upper portion of shell 11 to lift away from bottle 12 while the lower portion of shell 11 remains attached to fixed element 30, the seal between the liner in top wall 24 of closure 10 and rim 26 of bottle 12 breaks to allow venting of gas. The pressurized gas is vented along the threads and past openings 40. In other constructions, additional conventional venting devices may be present such as those discussed in the Background of Invention, supra.

Figure 2C:
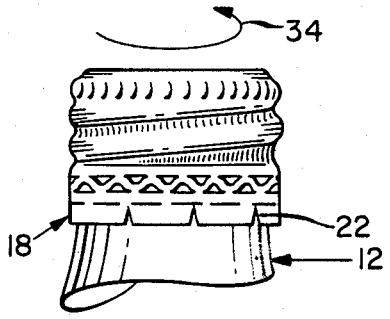
FIG. 2C is a view of the cap of FIG. 2B after the safety section releases the fixed element of the bottle.

Upon further rotation in the direction indicated by arrow 34, FIG. 2C, safety section 18 finally releases the fixed element of bottle 12. Slits 22 expand to provide wedge-shaped openings as the lower portion of safety section 18 is lifted over the fixed element.

Figure 3A:
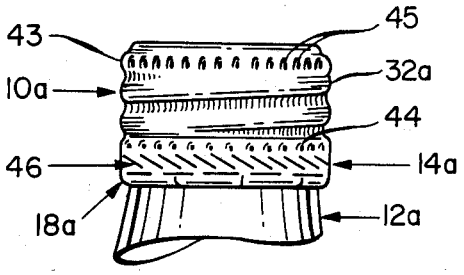
FIG. 3A–3C are elevational plan views of a cap including an alternative expandable section having a band of diagonal slots which expand during rotation of the cap.
Figure 3B:
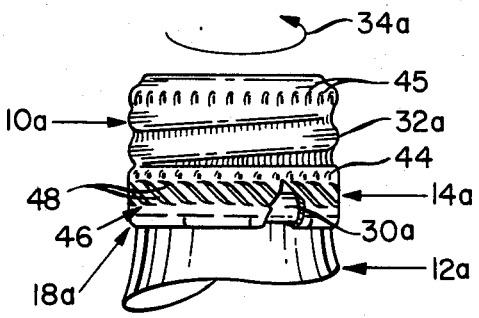
Figure 3C:
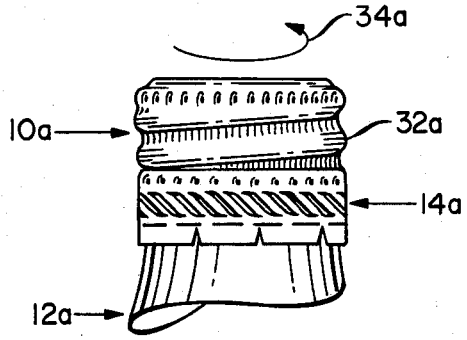

Another construction of a container closure according to this invention is shown in FIGS. 3A–3C. Closure **10*a* includes knurled grip 43, rolled threads 32*a*, conventional vent openings 44, 45, expandable section 14*a*, and safety section 18*a*. Expandable section 14*a* includes diagonal slots 46. When closure 10*a* is unscrewed in the direction indicated by arrow 34*a*, the material surrounding slots 46 deforms to produce openings 48, i.e., the slots become enlarged. During the axial expansion of section 14*a* safety section 18*a* remains axially fixed, as revealed in partial cutaway, to fixed element 30*a* of bottle 12*a*. Pressurized gas beneath closure 10*a* is vented through vent openings 44 and openings 48**.

Safety section **18*a* is frangible such that it separates from the fixed element of bottle 12*a* after sufficient force is applied to it. After further opening rotation, closure 10*a* is sufficiently lifted axially to rupture frangible safety section 18*a*** and lift it past the fixed element.

Figure 4:
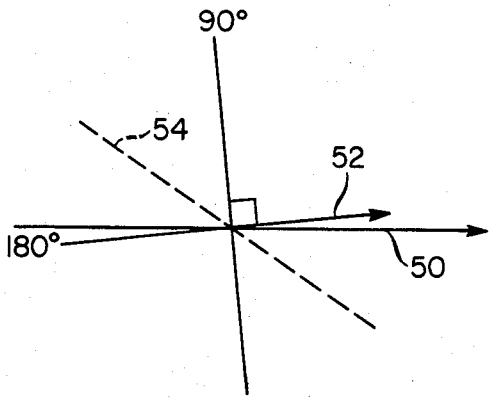
FIG. 4 is a chart of the preferred orientation of the slots of FIGS. 3A–3C relative to the orientation of the cap threads and the direction of rotation of the cap.

The orientation of slots 46 relative to the direction of opening rotation 34 and the orientation of threads **32*a* is shown in FIG. 4. A first direction of opening rotation is illustrated by line 50. The inclined orientation of threads 32*a* is depicted by line 52. Dashed line 54 lies between 90° and 180° from line 52 to represent the upward orientation of slots 46. If slots 46 sloped upwardly at less than 90°, the material surrounding slots 46** is likely to force the slots closer together rather than open and deform them.

Although the novel expandable section has been described above in terms of slots in a malleable material such as metal, this is not a limitation of this invention. Any material, such as a plastic, which expands when upward force is applied to it is acceptable. The force required to expand the axially expandable section should be less than the force required to release the safety section so that pressurized gas is significantly vented before the safety section is ruptured.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. An improved container closure comprising:

a shell with top and side walls and disposable over an opening in a container;

a threaded portion in said side wall for engaging threads on the container;

an axially expandable section in said shell; and a safety section in said side wall below said expandable section for provisionally securing said shell to a fixed element on the container at least until said expandable section expands.

2. The closure of claim 1 in which said expandable section includes a plurality of slots, disposed in said side wall, which expand when said shell is rotated in a first direction to eventually disengage said shell from the container.

3. The closure of claim 2 in which said slots are arranged in at least two bands about said shell.

4. The closure of claim 3 in which said slots in one band are staggered relative to said slots in the other band.

5. The closure of claim 2 in which said slots are oriented transversely to the orientation of threads in said threaded portion.

6. The closure of claim 5 in which said threads are inclined upward in a second direction and said slots are oriented upward in a third direction which is at least ninety degrees from the second direction.

7. The closure of claim 1 said expandable section is disposed below said threaded portion.

8. The closure of claim 1 in which said expandable section requires less force to expand than is required to release said safety section from the fixed element.

9. The closure of claim 8 in which said safety section includes a frangible portion.

10. The closure of claim 1 in which said expandable section enables venting of pressure within said shell to prevent closure-missiling during initial rotation of said shell before said safety section releases the fixed element.

11. The closure of claim 1 in which said expandable section includes metal.

12. An improved container closure comprising:

a shell with top and side walls and disposable over an opening in a container;

an axially expandable section in said shell; and a safety section in said side wall below said expandable section for provisionally securing said shell to a fixed element on the container at least until said expandable section expands.

13. In combination with a pressurized-fluid container having external threads proximate its opening and having a fixed element below said threads, an improved container closure comprising:

a shell with top and side walls and disposable over said opening;

a threaded portion in said side walls for engaging said threads on said container;

an axially expandable section in said shell; and a safety section in said side wall below said expandable section for provisionally securing said shell to said fixed element on said container at least until said expandable section expands.

14. The closure of claim 13 in which said fixed element is annular.

15. The closure of claim 13 in which said expandable section requires less force to expand than is required to release said safety section from said fixed element.

16. The closure of claim 13 in which said expandable section enables venting of pressure within said shell to prevent closure-missiling during initial rotation of said shell before said safety section releases said fixed element.

17. The closure of claim 13 in which said expandable section includes a plurality of slots, disposed in said side wall, which expand when said shell is rotated in a first direction to eventually disengage said shell from said container.

* * * * *